US007677406B2

(12) United States Patent
Maxson

(10) Patent No.: US 7,677,406 B2
(45) Date of Patent: Mar. 16, 2010

(54) INSULATING CONTAINER

(76) Inventor: Floyd S. Maxson, 4548 NE. 6th Ave., Oakland Park, FL (US) 33334

( * ) Notice: Subject to any disclaimer, the term of this patent is extended or adjusted under 35 U.S.C. 154(b) by 757 days.

(21) Appl. No.: 11/355,756

(22) Filed: Feb. 16, 2006

(65) Prior Publication Data

US 2007/0187416 A1 Aug. 16, 2007

(51) Int. Cl.
*B65D 81/38* (2006.01)
*A47J 41/00* (2006.01)

(52) U.S. Cl. ..... 220/592.26; 220/592.2; 220/592.03; 220/592.09; 220/254.3; 62/457.1; 62/457.7

(58) Field of Classification Search ..... 220/230, 220/254.1, 254.3, 254.6, 592.03, 592.09, 220/592.2, 592.23, 592.24, 592.26, 915.1–915.2, 220/DIG. 8, DIG. 10; 62/371, 440, 457.1, 62/457.7; 383/110–111
See application file for complete search history.

(56) References Cited

U.S. PATENT DOCUMENTS

| | | | | |
|---|---|---|---|---|
| 4,375,828 | A | 3/1983 | Biddison | |
| 4,537,313 | A | 8/1985 | Workman | |
| 4,598,746 | A | 7/1986 | Rabinowitz | |
| 4,629,040 | A | 12/1986 | Jones | |
| 4,899,904 | A * | 2/1990 | Dooley et al. | 220/592.16 |
| 4,929,094 | A | 5/1990 | Becker | |
| 4,988,216 | A * | 1/1991 | Lyman | 383/74 |
| 5,090,526 | A | 2/1992 | Jacober | |
| 5,337,911 | A * | 8/1994 | Holub | 220/254.3 |
| 5,403,095 | A | 4/1995 | Melk | |
| 6,068,402 | A | 5/2000 | Freese et al. | |
| 6,070,718 | A * | 6/2000 | Drabwell | 206/216 |
| 6,247,328 | B1 * | 6/2001 | Mogil | 62/457.2 |
| 6,269,587 | B1 * | 8/2001 | Wallace | 43/54.1 |
| 6,481,239 | B2 * | 11/2002 | Hodosh et al. | 62/457.4 |
| 6,582,124 | B2 | 6/2003 | Mogil | |
| 7,195,132 | B1 * | 3/2007 | Balam | 220/560 |
| 7,240,513 | B1 * | 7/2007 | Conforti | 62/457.2 |
| 2004/0074936 | A1 * | 4/2004 | McDonald | 224/148.5 |

* cited by examiner

*Primary Examiner*—Anthony Stashick
*Assistant Examiner*—Madison L Wright
(74) *Attorney, Agent, or Firm*—Dale J. Ream

(57) ABSTRACT

An insulation container includes a flexible exterior container and a rigid interior container for maintaining stored items at a cool temperature. The exterior housing includes a lid for selectively sealing the entire open top thereof for selectively inserting or removing large or multiple items, the lid having an auxiliary door for quickly removing small or single items from the internal storage area. Opening only the auxiliary door also helps to maintain the internal temperature for a longer time than is possible if the entire lid is opened. The interior housing may be constructed of stainless steel for enhanced insulation with an intermediate housing sandwiched between interior and exterior housings. The intermediate housing may include a rubber material for preventing condensation from forming on the exterior housing.

3 Claims, 4 Drawing Sheets

INSULATING CONTAINER

BACKGROUND OF THE INVENTION

The present invention relates generally to coolers and, more particularly, to an insulated cooler having a first quick access opening to access interior contents and a larger opening for initially filling the cooler with ice, food, or beverages. The cooler also includes a rubber-coated stainless steel insert for keeping items cool while being leak proof.

Insulated coolers are frequently used for keeping food and beverages cold for later use. Coolers traditionally include a full top panel attached with hinges or zippers for providing full access to the food or beverages therein. Unfortunately, frequent opening and closing of the cooler allows a large loss of the coolness therein. The construction and materials of other coolers lack a construction able to maintain a cold temperature for very long. A still further difficulty with some coolers is that their construction may cause a buildup of exterior condensation, or "sweat."

Therefore, it would be desirable to have an insulated cooler having a steel inner housing that provides superior insulation for maintaining a cold internal environment for a long period of time. Further, it would be desirable to have an insulated cooler which does not experience an undesirable buildup of exterior condensation. In addition, it would be desirable to have an insulated cooler having a large zippered panel that may be selectively opened for depositing or removing large amounts of the cooler's contents as well as having a smaller panel that provides quick access for removal of single items.

SUMMARY OF THE INVENTION

Therefore, an insulating container according to the present invention includes exterior and interior housings. The housings provide a superior construction for insulation and superior access for user convenience. The exterior housing includes bottom and side walls, defines an open top, an open interior area, and includes a lid for selectively sealing the open top. The interior housing also includes a bottom wall and side walls defining an open top and storage area. The interior housing is configured to be positioned in the exterior housing open area. When the lid is in an open configuration, large items may be inserted into the storage area of the interior housing. The lid of the exterior housing also includes an auxiliary door that provides quick access to the storage area for removal of smaller or singular items.

Therefore, a general object of this invention is to provide an insulation container that maintains stored items at a cold temperature without significant condensation buildup.

Another object of this invention is to provide an insulation container, as aforesaid, having a first large access lid for insertion or removal of large items and a smaller auxiliary access panel operatively connected to the large access lid for quick removal of smaller or singular items.

Still another object of this invention is to provide an insulation container, as aforesaid, that includes exterior, interior, and intermediate housings for enhanced insulation characteristics.

Yet another object of this invention is to provide an insulation container, as aforesaid, in which the exterior housing is constructed of a flexible material, the interior housing is constructed of a generally rigid material, and the intermediate layer includes a rubber material for preventing condensation from forming on the exterior housing.

Other objects and advantages of the present invention will become apparent from the following description taken in connection with the accompanying drawings, wherein is set forth by way of illustration and example, an embodiment of this invention.

DESCRIPTION OF THE PREFERRED EMBODIMENT

An insulating container 100 according to the present invention will now be described in detail with reference to FIGS. 1 through 4*b* of the accompanying drawings. More particularly, an insulating container 100 according to the current invention includes an exterior housing 110 and an interior housing 120.

Figure 1:
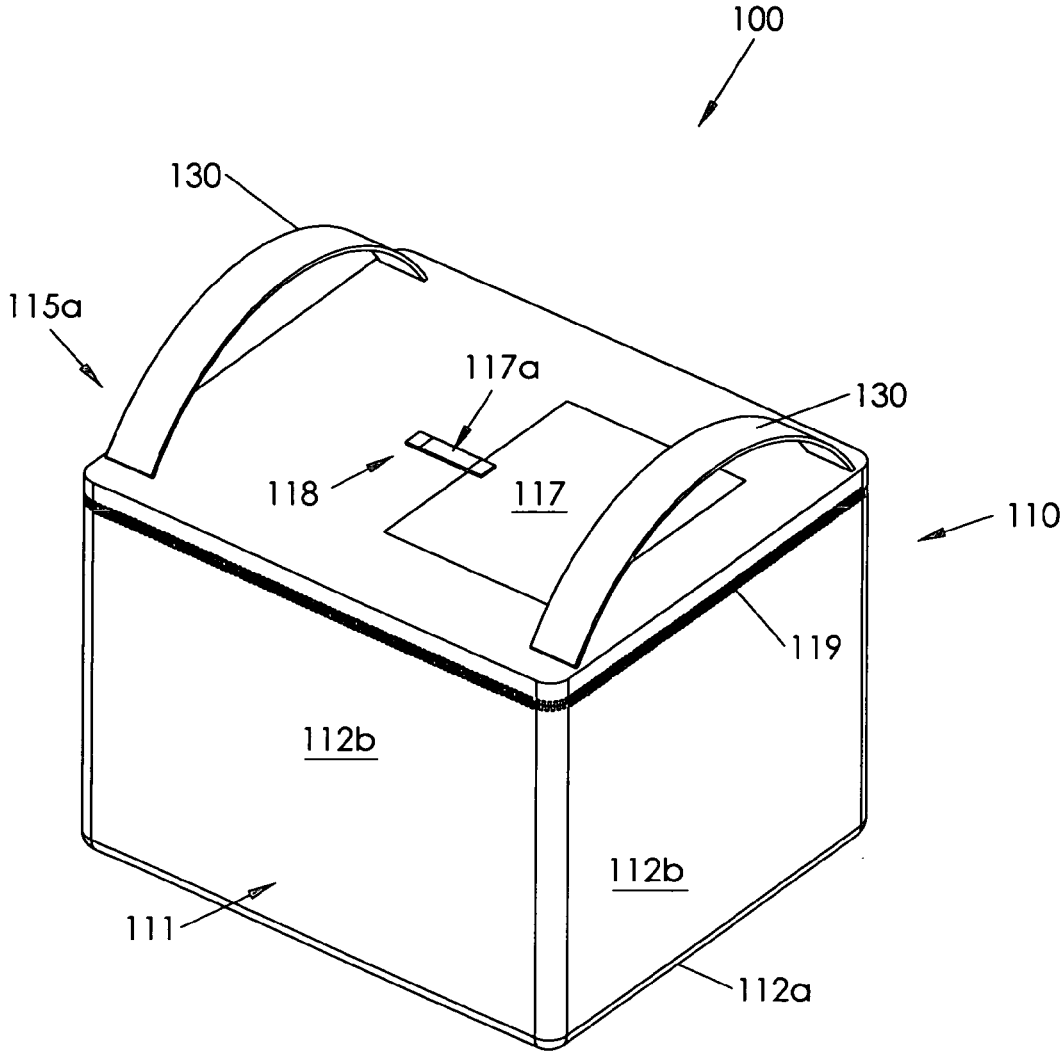
FIG. 1 is a perspective view of an insulation container according to a preferred embodiment of the present invention.
Figure 2:
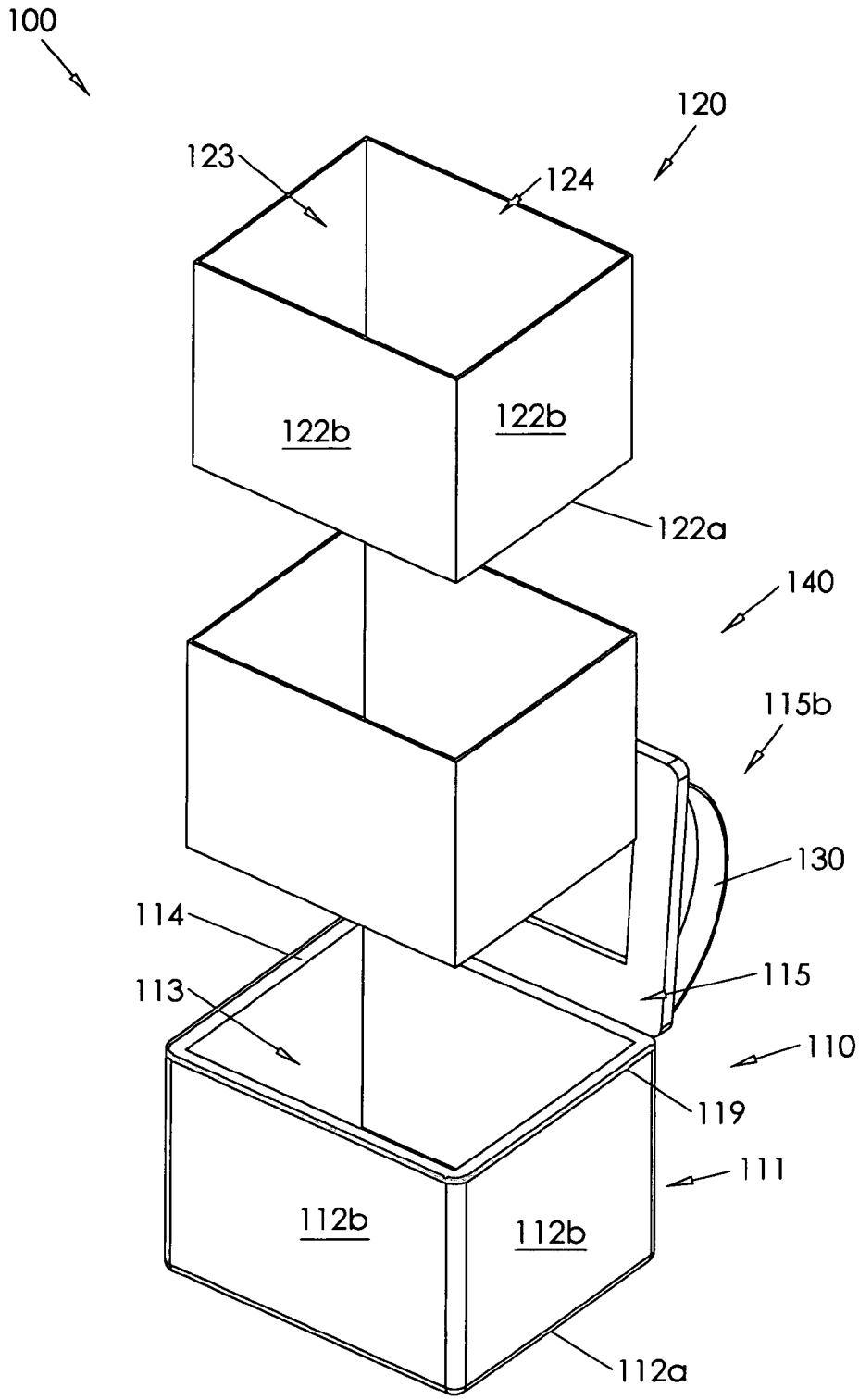
FIG. 2 is an exploded view of the insulation container as in FIG. 1.

The exterior housing 110 has a lower portion 111 and an upper portion 115 (also called "lid 115"). The lower portion 111 has a bottom wall 112*a* and one or more sidewall 112*b* extending upwardly therefrom, as shown in FIGS. 1 and 2. The bottom wall 112*a* and the one or more sidewall 112*b* cooperatively define an open area 113, and the one or more sidewall 112*b* defines an open top side 114 in communication with the open area 113 (FIG. 2).

As shown in FIG. 2, the interior housing 120 defines an open storage area 123 and has an open top side 124 (also referred to as "open upper end 124") in communication with the storage area 123. More particularly, the interior housing 120 may have a bottom wall 122*a* and one or more sidewall 122*b* extending upwardly therefrom. The interior housing bottom wall 122*a* and the one or more interior housing sidewall 122*b* may cooperatively define the open storage area 123, and the one or more interior housing sidewall 122*b* may define the open upper end 124. The interior housing 120 is preferably positionable in the exterior housing open area 113.

Figure 3A:
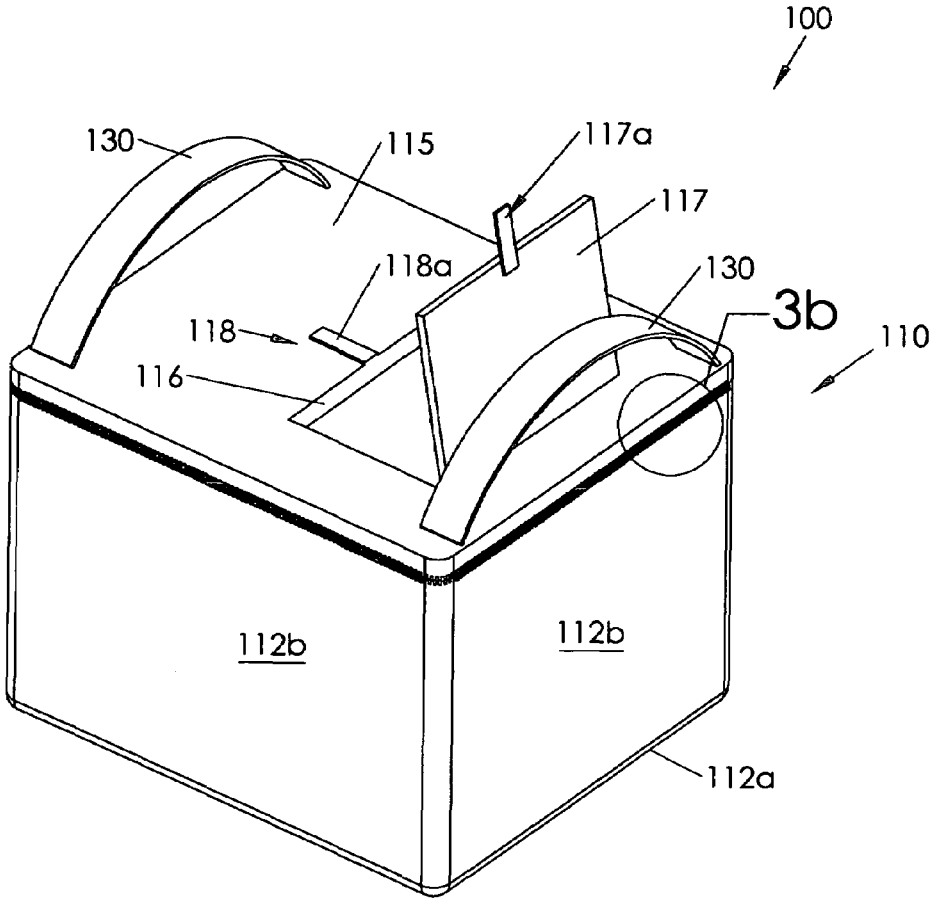
FIG. 3*a* is a perspective of the insulation container as in FIG. 1 with an auxiliary door in an open configuration.
Figure 3B:
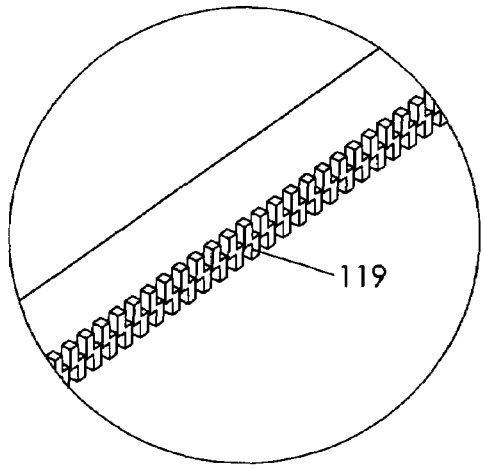
FIG. 3*b* is an isolated view on an enlarged scale of a portion of a fastener for selectively sealing a lid on an open top of an exterior housing of the insulation container as in FIG. 1.

The lid 115 is sized and coupled to the exterior housing lower portion 111 to selectively seal the open top side 114 of the exterior housing 110, as shown in FIG. 1. This allows the lid 115 to selectively enclose the exterior housing open area 113. As shown throughout the drawings, the lid 115 may define an opening 116, and the lid may include at least one strap 130 for a user to selectively hold. The opening 116 is preferably in communication with the interior housing storage area 123 when the interior housing 120 is positioned in the exterior housing open area 113 and the lid 115 is at a closed position 115*a* (FIG. 1). When the lid 115 is at the closed position 115*a*, the lid 115 may seal the open top side 114 of the exterior housing 110. As shown in FIGS. 3*a* and 3*b*, a zipper 119 may selectively couple the lid 115 and the exterior housing lower portion 111.

Figure 4A:
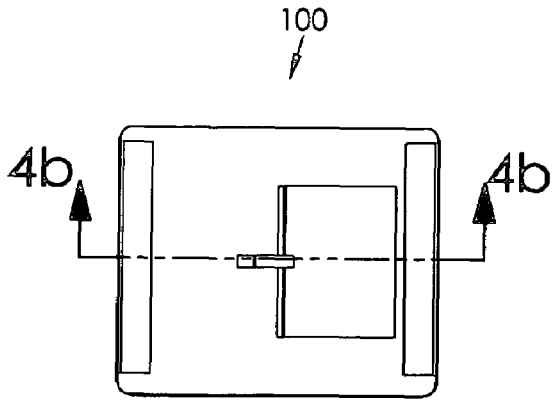
FIG. 4*a* is top view of the insulation container as in FIG. 1.
Figure 4B:
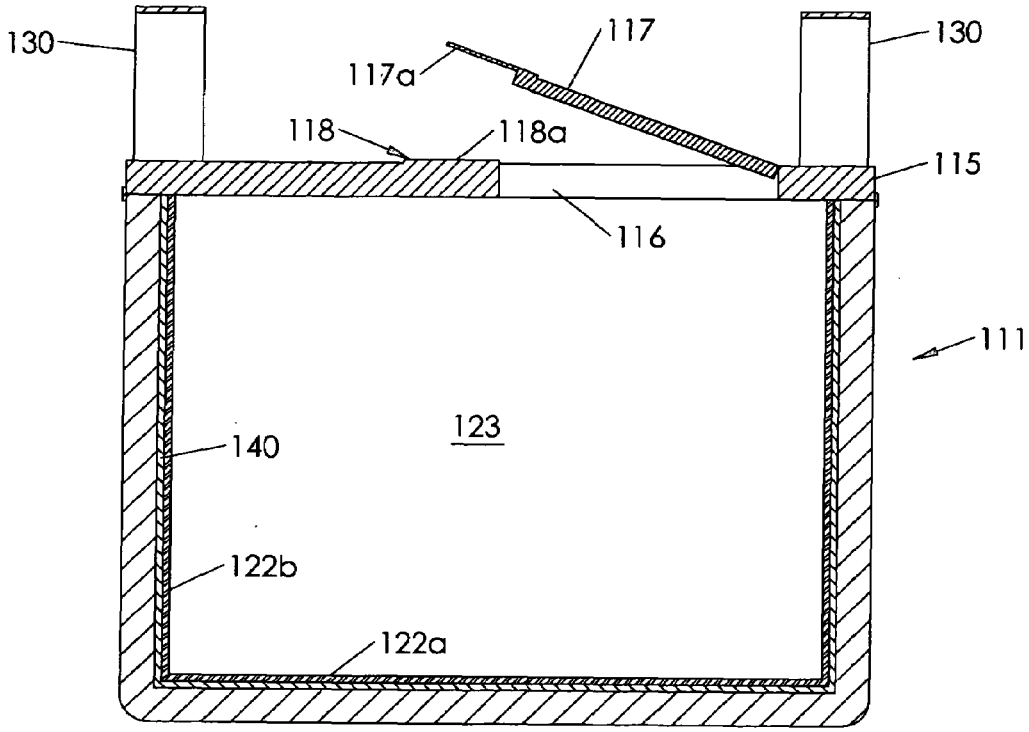
FIG. 4*b* is a sectional view taken along line 4*b*-4*b* as in FIG. 4*a*.

An auxiliary door 117 (FIGS. 1-3*a*, 4*a*, and 4*b*) may be coupled to the lid 115 to selectively close the lid opening 116. As shown in FIGS. 3*a* and 4*b*, a clasp 118 may be attached to the lid 115 for selectively securing the auxiliary door 117 to the lid 115. While the clasp 118 may be any of a variety of fasteners, it is currently preferred that the clasp 118 include a magnetic portion 118*a* having a first polarity. The auxiliary door 117 may then include a magnetic portion 117*a* that has a polarity that is complementary to the polarity of the clasp magnetic portion 118*a*, and as shown in FIGS. 1, 4*a*, and 4*b*, the clasp magnetic portion 118*a* and the auxiliary door magnetic portion 117*a* are preferably positioned to abut when the auxiliary door 117 closes the lid opening 116.

As shown in FIG. 2, an intermediate layer 140 may be sandwiched between the interior and exterior housings 110, 120 to further insulate the open storage area 123 and to reduce the formation of condensation on the exterior housing 110. The intermediate layer 140 may be attached to the exterior housing 110 or the interior housing 120, or the intermediate layer 140 may be separate from both the exterior and interior housings 110, 120. While the exterior housing 110, the interior housing 120, and the intermediate layer 140 may be constructed from a variety of appropriate materials, it is currently preferred that the exterior housing 110 is constructed from a flexible material (such as nylon), the interior housing 120 is constructed from a rigid material (such as metal or plastic), and the intermediate layer 140 includes rubber. Rubber is understood to include both natural rubber and any of numerous synthetic elastic materials of varying chemical composition with properties similar to those of natural rubber.

In use, the lid 115 may be moved from the closed position 115*a* (FIG. 1) to an open position 115*b* (FIG. 2). This may require using the zipper 119 to un-couple the lid 115 and the exterior housing lower portion 111. Once the lid 115 is at the open position 115*b*, the interior housing 120 may be positioned in the exterior housing open area 113. Food, drinks, ice, heat packs, and/or other items may be easily placed in the interior housing storage area 123 through the open upper end 124. The lid 115 may then be returned to the closed position 115*a*, and the zipper 119 may be used to couple the lid 115 and the exterior housing lower portion 111. When a user wants to easily and quickly access the interior housing storage area 123, he may open the auxiliary door 117 (FIG. 3*a*). The auxiliary door 117 may then be shut to again enclose the interior housing storage area 123, and the clasp 118 may secure the auxiliary door 117 to the lid 115 (FIG. 1). In this manner, the storage area 123 may be accessed in multiple ways, and each way may have advantages. For example, accessing the storage area 123 by opening the lid 115 may allow the entire storage area 123 to be accessed, and accessing the storage area 123 by opening the auxiliary door 117 may allow a portion of the storage area 123 to be accessed easily and quickly.

It is understood that while certain forms of this invention have been illustrated and described, it is not limited thereto except insofar as such limitations are included in the following claims and allowable functional equivalents thereof.

What is claimed is as follows:

1. An insulating container, comprising:

an exterior housing having a bottom wall and one or more sidewall extending upwardly therefrom to cooperatively define an open area, said one or more exterior housing sidewall defining an open top side in communication with said open area;

an interior housing having a bottom wall and one or more sidewall extending upwardly therefrom to cooperatively define an open storage area, said one or more interior housing sidewall defining an open upper end in communication with said storage area, said interior housing having a configuration positionable in said exterior housing open area such that respective interior and exterior housing walls are adjacent one another;

an intermediate layer having an intermediate layer bottom wall and a plurality of intermediate layer side walls extending upwardly from said intermediate layer bottom wall, said intermediate layer bottom and side walls having a configuration complementary to respective walls of said interior and exterior housings and sandwiched between said respective walls of said interior and exterior housings, said intermediate layer being constructed of rubber to insulate said open storage area and to reduce the formation of condensation on said respective walls of said exterior housing;

a lid coupled to said exterior housing and selectively movable between a closed position that seals said open top side of said exterior housing and an open position for access to said exterior housing open area through said open top side of said exterior housing;

wherein said lid defines an opening in communication with said interior housing storage area when said interior housing is positioned in said exterior housing open area and said lid is at said closed position;

an auxiliary door is coupled to said lid and is movable between open and closed configurations, whereby to selectively close said lid opening; and a clasp attached to a top surface of said lid to selectively secure said auxiliary door to said lid.

2. The container as in claim 1, wherein:

said clasp includes a magnetic portion having a first polarity;

said auxiliary door includes a magnetic portion having a polarity that is complementary to said first polarity; and said clasp magnetic portion and said auxiliary door magnetic portion are positioned to abut when said auxiliary door closes said lid opening.

3. The container as in claim 2, wherein a zipper selectively couples said exterior housing and said lid.

* * * * *